United States Patent [19]

Wilson

[11] 4,257,186

[45] Mar. 24, 1981

[54] APPARATUS FOR FLYING TOY AIRPLANE

[76] Inventor: William L. Wilson, 85 Appian Way, Arden, N.C. 28704

[21] Appl. No.: 54,716

[22] Filed: Jul. 5, 1979

[51] Int. Cl.[3] ..... A63H 27/04

[52] U.S. Cl. ..... 46/77; 46/51

[58] Field of Search ..... 46/77, 51, 52; 273/58 C, 413, 414

[56] References Cited

U.S. PATENT DOCUMENTS

| | | | |
|---|---|---|---|
| 2,303,965 | 12/1942 | Walker | 46/51 |
| 2,416,805 | 3/1947 | Walker | 46/77 |
| 2,547,776 | 4/1951 | Rankin | 46/51 X |
| 2,947,108 | 8/1960 | Dodd, Jr. et al. | 46/51 |

*Primary Examiner*—Robert Peshock
*Assistant Examiner*—Mickey Yu
*Attorney, Agent, or Firm*—Jones, Thomas & Askew

[57] ABSTRACT

Hand-held apparatus for flying a tethered aerodynamic device such as a toy airplane or the like. The device includes a pair of control members interconnected for mutual adjustment, and a tether cord which engages both control members, so that the effective length of the tether cord can be varied in response to varying the relative position of the control members.

6 Claims, 3 Drawing Figures

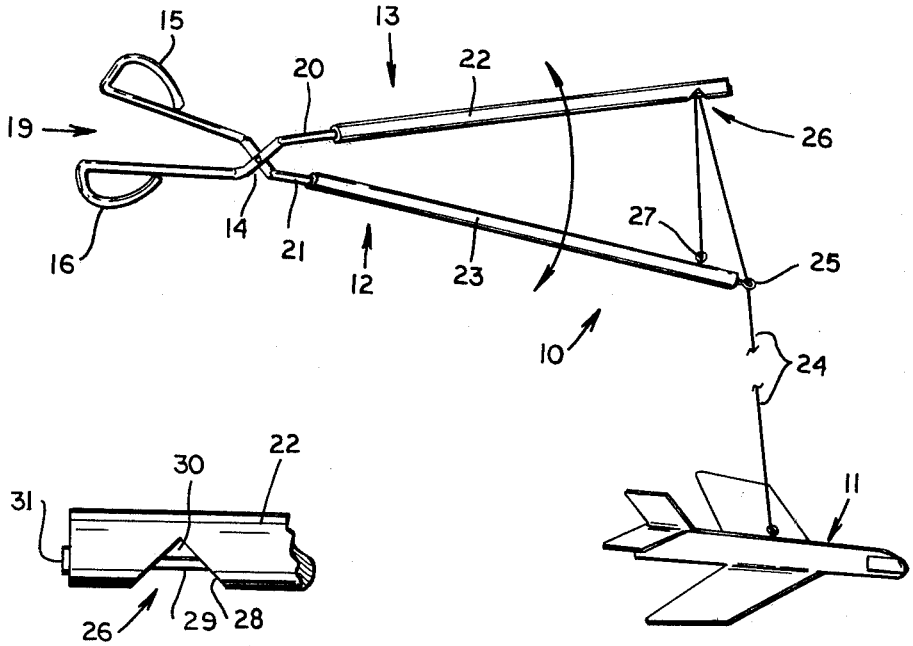
Fig. 2
Fig. 1
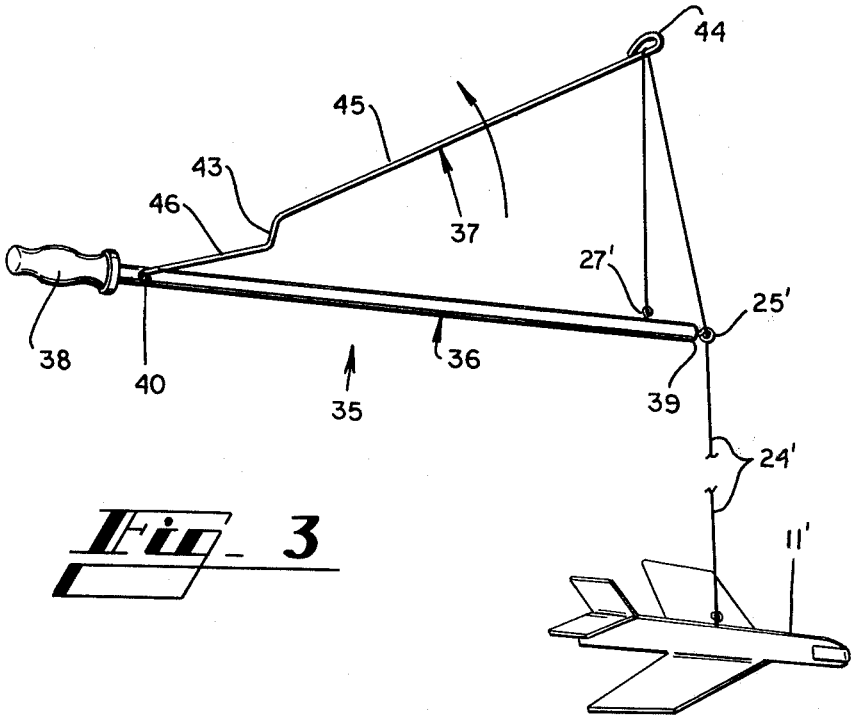
Fig. 3

APPARATUS FOR FLYING TOY AIRPLANE

BACKGROUND OF INVENTION

This invention relates in general to toy flying apparatus, and in particular to hand-held apparatus for controlling an aerodynamic article such as a toy airplane or the like.

Flying devices such as airplanes and gliders are among the more popular toys, and seem to enjoy an enduring and recurring popularity. Perhaps the simplest flying device is the untethered airplane that is unpowered and is launched simply by throwing the airplane by hand. The untethered airplane may simply glide for a distance or may turn loops or other aerobatic maneuvers, depending on the design of the airplane and the skill of the operator.

Another type of toy airplane is the so-called tethered airplane, which is connected to one or more cords or control lines held by the operator. The tethering line or lines keep the airplane within a predetermined distance from the operator, and in some cases permit the operator to control the flight of the airplane along a path of movement defined by the tethering line. One well-known example of tethered airplanes is the conventional control line powered model airplane, in which elevator control of the airplane is accomplished by a pair of control lines extending between the airplane and the operator.

Powered model airplanes are generally too expensive to be considered toys, and are too complicated and hazardous for use by younger children. Relatively simple toy airplane flying devices are known which are especially intended for unpowered airplanes or similar aerodynamic objects, and which include a tether to keep the airplane within a fixed distance of the operator. In order to maintain operator interest in such toy airplanes, it is desirable to provide at least some measure of operator control so that the operator can attempt to put the airplane through various maneuvers. While devices are known in the prior art for permitting operator control of a tethered toy airplane, for example by changing the effective length of the tether, those devices tend to have disadvantages such as requiring two hands for operation or being unable to control the tether at the whim of the operator.

SUMMARY OF INVENTION

The present invention provides toy airplane flying apparatus in which the effective length of a tether line between the airplane and the operator is selectably and independently variable by the operator. The apparatus includes a first control member to which the tether line is connected, and a second control member movable relative to the first control member to vary the effective length of the tether extending to a toy airplane or other aerodynamic flying object. The two control members are designed to be manipulatable with one hand, so that a person can manipulate the apparatus to vary the effective length of the tether while moving the control apparatus with one hand to fly the airplane.

BRIEF DESCRIPTION OF DRAWING

FIG. 1 is a pictorial view showing a first disclosed embodiment of the present invention, with the tether line shown broken for illustrative purposes.

FIG. 2 is an enlarged fragmentary portion of a control member in the embodiment of FIG. 1.

FIG. 3 is a pictorial view of another disclosed embodiment according to the present invention, with the tether line shown broken for illustrative purposes.

DETAILED DESCRIPTION OF DISCLOSED EMBODIMENTS

Turning first to FIG. 1, there is shown generally at 10 a flying apparatus according to a first disclosed embodiment of the present invention, and connected to an aerodynamic device such as the toy airplane 11. The flying apparatus 10 includes a first control member 12, and a second control member 13 connected to the first control member at a pivotable connection 14. The first and second control members 12 and 13 are shown in FIG. 1 as comprising a scissors-connected device 19 including the handle ends 15 and 16 designed to be grasped by the thumb and index finger of one hand; the pivotable connection 14; a pair of rods 20 and 21; and the pair of extension members 22 and 23 respectively connected to the rods 20 and 21. It should be understood of course, that unitary members may be substituted for the disclosed arrangement of rods and extension members.

The airplane 11 is connected to the apparatus 10 by a tether line 24, which passes freely through an eyelet 25 at the outer end of the extension member 23, thence passing freely around the line guide 26 located adjacent the outer end of the extension member 22, and terminating in connection to the eyelet 27 secured adjacent to the end of the extension member 23. Details of the line guide 26 are shown in FIG. 2, wherein the guide is seen to include a V-shaped notch 28 cut upwardly into the underside of the extension member 22. A pin 29 extends through the notch 28 spaced apart from the apex of the notch, leaving a space 30 between the pin and the apex through which the line 24 can freely pass. The pin 29 may conveniently be provided by a nail 31 driven into the outer end of the extension member 22, in the case where the extension member is wooden. It will also be seen that the guide 26 may alternatively be provided by a conventional eyelet extending outwardly from the end of the extension member 22, although the use of an eyelet for the guide 26 may interfere with the tether line connecting eyelet 27.

It will now be apparent that the effective length of the line 24, i.e., the length of line between the eyelet 25 and the airplane 11, is determined by the relative angular position of the first control member 12 and second control member 13. The effective length of the line 24 is maximized when the two control members 12 and 13 lie substantially along side each other, and the effective length of the line is correspondingly reduced as the two control members are moved mutually apart.

The operation of the present flying apparatus is now discussed, with emphasis primarily on the control features provided by the selectably variable effective length of the line 24. The person flying the airplane grasps the scissors-like device 19 so that the handle ends 15 and 16 can be selectably opened and closed by movement of the person's thumb relative to index or other fingers. Flying movement of the airplane 11 is induced by moving the entire apparatus 10 in a desired path, for example, in a circular or figure-eight pattern while the operator remains stationary, or in a horizontal circle while the operator rotates by arm or body movement. The operator can vary the effective length of the line 24 at will, simply by opening or closing the handle ends 15 and 16 to provide a corresponding adjustment of the first and second control members 12 and 13. The one-handed operation of the device 10 allows the line 24 to be shortened or lengthened at will, concurrently with other flying maneuvers, thereby greatly increasing the control of the operator over the airplane 11 and enhancing the many types of interesting maneurvers through which the airplane 11 may be put. If the line 24 is broken in use, a replacement line can easily be attached both to the airplane 11 and to the eyelet 27 mounted on the first control member 12, after threading the line through the guide 26 on the second control member 13 and through the eyelet 25. Other airplanes or aerodynamic devices can be substituted for the particular airplane 11 at the whim of the operator, so that a particular flying apparatus 10 may be used with various airplanes provided either with the apparatus 10 or otherwise as the operator desires.

Turning next to FIG. 3, there is shown an alternative embodiment indicated generally at 35 and including a first control member 36 and a second control member 37; the first and second control members are functionally similar to the corresponding members 12 and 13 shown and described for the first embodiment. The construction and operation of the two control members 36 and 37 do differ somewhat from the corresponding members of the preceding embodiment, as pointed out below.

The first control member 36 is an elongated rod made of any suitable material such as wood, and having a convenient grasping handle 38 disposed at one end. Adjacent the other end of the first control member is an eyelet 27' for securing one end of the tether line 24, and at the far end 39 of the first control member is another eyelet 25' through which the line 24' freely passes.

The second control member 37 is provided by a stiff wire rod, in the disclosed embodiment of FIG. 2, having one end pivotably connected to the first control member 36 by means of the connection 40, preferably located on the first control member adjacent to the handle 38. The pivotably connection 40 may be provided by any suitable means, such as by a screw or bolt extending through a loop formed in an end of the second control member 37 and secured to the first control member 36. A joggle 43 is formed in the second control member 37 a short distance outwardly from the pivotably connection 40, and the free end of the second control member terminates in a loop 44 through which the line 24' freely passes. It can be seen that the loop 44 provides the same line guiding function as the guide 26 formed adjacent the free end of the second control member 13, in the embodiment of FIG. 1. It can also be seen from FIG. 3 that the joggle 43 formed in the second control member 37 permits the control member portion 45, extending from the joggle outwardly to the loop 44, to remain parallel to the first control member 36 and spaced a distance apart therefrom, whenever the remaining portion 46 of the second control member lies alongside the first control member.

In operating the embodiment shown in FIG. 3, the handle 38 of the first control member 36 is grasped in one hand. The portion 46 of the second control member 37 can be manipulated by the thumb and/or index finger, so that the angular position of the relatively lightweight second control member 37, relative to the first control member 36, can be readily varied as the operator is swinging or otherwise moving the apparatus 35 to fly the airplane 11'.

It will thus be seen that there have been described two separate but related embodiments of apparatus for flying a toy airplane so as to selectably adjust the effective length of the tether line or cord connecting the airplane to the apparatus. It will be appreciated that the effective length of the tether can be increased or decreased at will while the plane is flown, without resort to winding spools or to apparatus requiring both hands of the operator.

It will be understood that the foregoing refers only to disclosed embodiments of the present invention, and that numerous changes or modifications may be made therein without departing from the spirit or the scope of the invention as defined in the following claims.

I claim:

1. Toy airplane flying apparatus for manual manipulation, comprising:

a first control member for tethering a cord leading to an aerodynamic flying object;

first means on said first control member for engagement by a hand of a person manipulating the flying object;

a second control member attached in selectably movable relation to said first control member and having a portion operative to be located at a variable distance from said first control member in response to relative movement of said second control member;

second means on said second control member for engagement and selectable manipulation by the same hand which concurrently engages said first means; and cord engaging means on said second portion of said second control member and operatively engaging said cord so as to change the free length of the cord extending from said first control member to said flying object, in response to said movement of said control member.

2. Apparatus as in claim 1, further comprising:

anchor means mounted on said first control member to tether an end of the cord;

said cord engaging means comprises a first guide member through which the cord extends from said tether end; and a second guide member mounted on said first control member, through which the cord extends from said first guide member and leading to said flying object.

3. Apparatus as in claim 1, wherein said second control member comprises a lever pivotably connected to said first control member.

4. Apparatus as in claim 1, wherein:

said first control member includes means defining a tether for an end of said cord; and said second control member is pivotably connected to said first control member at a location spaced apart from said tether defining means, so that said cord engaging means carried by said second control member is movable relative to said tether defining means in response to pivotable movement of said second control member relative to said first control member.

5. Apparatus as in claim 4, wherein:

said cord engaging means comprises a first guide member through which passes the cord extending from said tether defining means; and further comprising means mounted on said first control member to define a second guide member to locate the cord extending from said first guide member and leading to said flying object, so that the free length of cord from said second guide member to said flying object is controlled by pivotable movement of said second control member relative to said first control member.

6. Apparatus as in claim 5, wherein said second means on said second control member includes means for operative engagement and manipulation by a digit of the hand which grasps said first means on said first control member.

* * * * *